US005957301A

United States Patent [19]

Wedel et al.

[11] Patent Number: 5,957,301

[45] Date of Patent: Sep. 28, 1999

[54] METHOD AND APPARATUS FOR THE SEPARATION OF MATERIALS HAVING DIFFERENT DENSITIES

[75] Inventors: Andrew W. Wedel, Hollidaysburg, Pa.; Blaine F. Severin, Okemos; William G. Bickert, East Lansing, both of Mich.

[73] Assignee: Board of Trustees operating Michigan State University, East Lansing, Mich.

[21] Appl. No.: 08/707,657

[22] Filed: Sep. 4, 1996

Related U.S. Application Data

[63] Continuation-in-part of application No. 08/621,532, Mar. 25, 1996, Pat. No. 5,720,393.

[51] Int. Cl.[6] ..... B03B 5/60

[52] U.S. Cl. ..... 209/173; 209/208; 209/932

[58] Field of Search ..... 209/172.5, 172, 209/173, 208, 910, 913, 932, 18, 464

[56] References Cited

U.S. PATENT DOCUMENTS

| | | | |
|---|---|---|---|
| 2,025,841 | 12/1935 | Young | 209/173 X |
| 2,168,942 | 8/1939 | McClave . | |
| 2,530,676 | 11/1950 | Berg et al. | 209/173 |
| 2,559,403 | 7/1951 | Cover | 209/173 |
| 2,933,187 | 4/1960 | Old et al. . | |
| 3,722,035 | 3/1973 | Hanks | 209/173 X |
| 4,297,208 | 10/1981 | Christian . | |
| 4,324,652 | 4/1982 | Hack . | |
| 4,617,113 | 10/1986 | Christophersen . | |
| 4,851,036 | 7/1989 | Anthes et al. . | |
| 4,944,868 | 7/1990 | Jay, Sr. et al. | 209/173 X |
| 5,368,731 | 11/1994 | Pesotini . | |
| 5,720,393 | 2/1998 | Wedel et al. | 209/13 |

OTHER PUBLICATIONS

Handling and Storage Systems For Sand–Laden Dairy Manure From Free Stall Barns, The Proceedings of the Third Inter. Dairy Housing Conf., Dairy Systems For the 21st Century 1994 ed.

Analysis of a Batch Aerated Grit Chamber Used to Separate Bedding Sand From Dairy Manure, 1995 ASAE Annual Intl. Meeting Paper No. 95–4705.

*Primary Examiner*—David H. Bollinger
*Attorney, Agent, or Firm*—Ian C. McLeod; Mary M. Moyne

[57] ABSTRACT

A method and apparatus (10) for separating materials having different size densities is described. The apparatus includes a trough (12), a dispersing and conveying screw means (40) and a fluid distribution manifold (26). The trough has upper and lower portions (12F and 12G) with the lower portion forming a pool area. The dispersing and conveying screw means has a conveying portion (46) and a dispersing portion (50). The conveying portion has flights (48) which move the first material (152) up the trough. The dispersing portion has paddles (52) which disperse the mixture (150) and convey the first material to the conveying portion. The fluid distribution manifold supplies both water and air to the inside (12I) of the trough through fluid orifices (28). In operation, the mixture is fed into the trough directly over the fluid orifices and the dispersing portion of the dispersing and conveying screw means. As the mixture enters the trough, the mixture is dispersed and forms an aqueous suspension with the water. The first material settles out of the aqueous suspension and is conveyed up the trough and out the upper discharge spout (14). The second material (154) remains suspended in aqueous suspension and flows over the overflow weir and out the lower discharge spout.

33 Claims, 3 Drawing Sheets

METHOD AND APPARATUS FOR THE SEPARATION OF MATERIALS HAVING DIFFERENT DENSITIES

The present application is a continuation-in-part of application Ser. No. 08/621,532, which was filed on Mar. 25, 1996, now U.S. Pat. No. 5,720,393.

BACKGROUND OF THE INVENTION (1) Field of the Invention

The present invention relates to a method and apparatus for the separation of materials having different densities in a mixture of the materials to allow for use or disposal of the different materials. In particular, the present invention relates to a method and apparatus for separating sand, which is used for bedding animals, such as cows, from manure in a sand and manure mixture to allow for easy disposal of the manure and reuse of the sand. The present invention also relates to a method and apparatus for use in the mining industry to separate materials having different densities.

The use of sand as a bedding for animals such as cows has become increasingly more widespread. It has been found that the use of sand as a bedding material for cows has several advantages over the traditionally used chopped straw, sawdust or wood shavings. Some of the benefits are improved udder health, increased cow comfort, cleaner cows, improved traction and lower cost. One drawback to the use of sand is the significant handling and storage problems associated with the resulting manure and sand mixture. The sand in the mixture obstructs the pumps normally used to irrigate the manure suspension onto the surrounding ground surface. Further, when the mixture is filled into pits, the sand eventually settles out of the mixture and fills the pit thus, requiring another pit or excavation of the pit. Either method of disposal is costly which can negate the benefits associated with the use of sand. To allow for easy disposal or storage of the mixture, the manure and sand must be separated. In the past, there was no quick and inexpensive way of separating the manure from the sand.

(2) Description of the Related Art

The related art has shown an assortment of liquid and solid separation systems common to waste water treatment operations as well as the dairy, mining and petroleum refining industries. The publication "Handling and Storage Systems For Sand-Laden Dairy Manure From Free Stall Barns", The Proceedings of the Third International Dairy Housing Conference, Dairy Systems for the 21st Century, 1994 ed. Ray Bucklin, American Society of Agricultural Engineers by some of the inventors describes the current methods of handling sand-laden dairy manure and of separating sand from sand-laden dairy manure. The paper also describes the characteristics of a settled sand profile and provides suggestions for long term handling and storage of sand-laden dairy manure. In addition, the publication, "Analysis of a Batch Aerated Grit Chamber Used to Separate Bedding Sand From Dairy Manure" 1995 ASAE Annual International Meeting Paper No. 95-4705 by the inventors describes several liquid, solid separation techniques and their effectiveness in separating sand from manure in a sand and manure mixture.

Some separation systems such as screening and dissolved air floatation are ineffective for use in separating manure and sand. Screening is ineffective due to the similarities in the particle size distributions of bedding sand and manure. Dissolved air floatation is ineffective because the minute bubbles are unable to float the large, coarse manure particles to the top of the tank for removal. Some other separation systems such as sedimentation and the hydrocyclone are more effective but have disadvantages. Sedimentation is an effective sand separation technique. However, the sand and manure settle out as layers with the manure on top of the sand. The layer of manure on the sand makes removal of the sand difficult without also removing the manure. In addition, dilution ratios in excess of 1:1 (mass parts of water to mass parts of sand laden manure) are required to separate a significant amount of sand from the manure. The separation does not increase for dilution rates greater than 3:1. Hydrocyclones have the potential to be effective sand separators. However, to be effective, the solid feed concentration must remain constant which is difficult to achieve with the manure and sand mixture.

Applications of aeration such as the Pachuca tank and continuous flow aerated grit chambers might also be used to separate sand from manure. However, the prior art does not disclose any such applications using these methods for the stated materials. Pachuca tanks are circular vessels with conical bottoms. Air is introduced at the apex of the conical bottom. The purpose of the conical bottom is to redirect settled solids into the upward flowing fluid so that they may be resuspended. However, because the manure and the sand co-exist in coagulated clumps of a large size, the effectiveness of this technique is reduced. Continuous flow aerated grit chambers consist of either a circular or rectangular concrete tank with air diffusers positioned above the bottom of the tank. The chamber operates as follows: i) influent waste water containing water, organic matter and grit enters the tank; ii) the energy inputted to the water by a continuous air flow creates hydraulic movement of the water; iii) grit settles out while organic material is kept in suspension and carried out of the tank; iv) the accumulated grit is then removed immediately from the tank; and v) effluent containing water and suspended organic matter flows out of the tank. The nature of the energy adsorption into the fluid is crucial to effective grit removal.

The related patent art has also shown various methods and apparatus for separating different materials having different sizes or weights using air and water to provide agitation to separate the materials. Illustrative are U.S. Pat. Nos. 2,933,187 to Old et al; U.S. Pat. No. 4,324,652 to Hack and U.S. Pat. No. 4,851,036 to Anthes et al.

Old et al describes an apparatus used for the floatation separation of particles, specifically concrete. The apparatus consists of a tank having an inclined bottom along which is mounted a combination agitator and conveyor. Water and air are introduced vertically into the deep end of the tank and the feeding of the material to be separated is downward into the tank opposite the air and water. In the separation process, the lightweight material floats and is discharged over the wall of the tank at the deep end. The heavier particles are moved along the tank upwardly toward the remote end where it is discharged. A removable, vertically oriented screen extends across the tank, intermediate the ends of the tank and prevents the lightweight material from moving with the heavy material toward the shallow end of the tank.

Hack describes a method and apparatus for scrubbing crude oil (bitumen) from tar-sands. The apparatus includes a pair of counter-rotating screw conveyors which tumble the tar-sand so as to rub the grains together and scrub the oil from the sand particles while at the same time moving the progressively cleaner sand toward the discharge end. An air-aspirating venturi underneath the sand lying in the bottom of the cell allows for simultaneously flushing and aerating the sand being tumbled to push the oil particles through the sand and carrying them to the surface.

Anthes et al describes a process and apparatus for separating relatively floatable particulate material from a mixture also having relatively non-floatable, particulate material. The apparatus includes a column with at least one baffle to promote turbulence within the column. Air is introduced into the column below the point of introduction of the mixture to be separated. Water is also added to the column. The rates of introduction of the mixture, air and water and the number and configuration of the baffles must be such as to create a substantial amount of turbulence in the column to keep the relatively floatable particulate matter at the upper portion of the column.

Also of interest is U.S. Pat. No. 4,617,113 to Christophersen et al which shows a floatation separating system. Only of minimal interest are U.S. Pat. Nos. 2,168,942 to McClave; U.S. Pat. No. 4,297,208 to Christian and U.S. Pat. No. 5,368,731 to Pesotini.

There remains a need for an apparatus which easily and quickly separates the materials having different densities in a mixture of the materials to allow for use or disposal of the different materials.

OBJECTS

It is therefore an object of the present invention to provide an apparatus and method for separating materials having different densities in a mixture of the materials to allow for use or disposal of the different materials. Further, it is an object of the present invention to provide an apparatus for separating materials having different densities which uses air and water to disperse the mixture to separate the mixture into the different materials. Still further, it is an object of the present invention to provide an apparatus for separating materials having different densities in a mixture of the materials where the material having the greater density settles out of the aqueous suspension for removal and the material having the lesser density is suspended in the aqueous suspension for removal. Further still, it is an object of the present invention to provide an apparatus for separating sand from manure in a manure and sand mixture which is quick and inexpensive and which provides reusable sand and an easily handlable manure suspension. Further, it is an object of the present invention to provide a method for separating manure and sand in a manure and sand mixture which is quick and inexpensive and which provides reusable sand and an easily handlable manure suspension. Still further, it is an object of the present invention to provide an apparatus which uses air and water to agitate an aqueous suspension containing the manure and sand mixture in order to separate sand from manure. Further still, it is an object of the present invention to provide an apparatus which uses rotating paddles to help disperse the mixture. These and other objects will become increasingly apparent by reference to the following drawings and the description.

DETAILED DESCRIPTION OF THE PREFERRED EMBODIMENT

Figure 1:
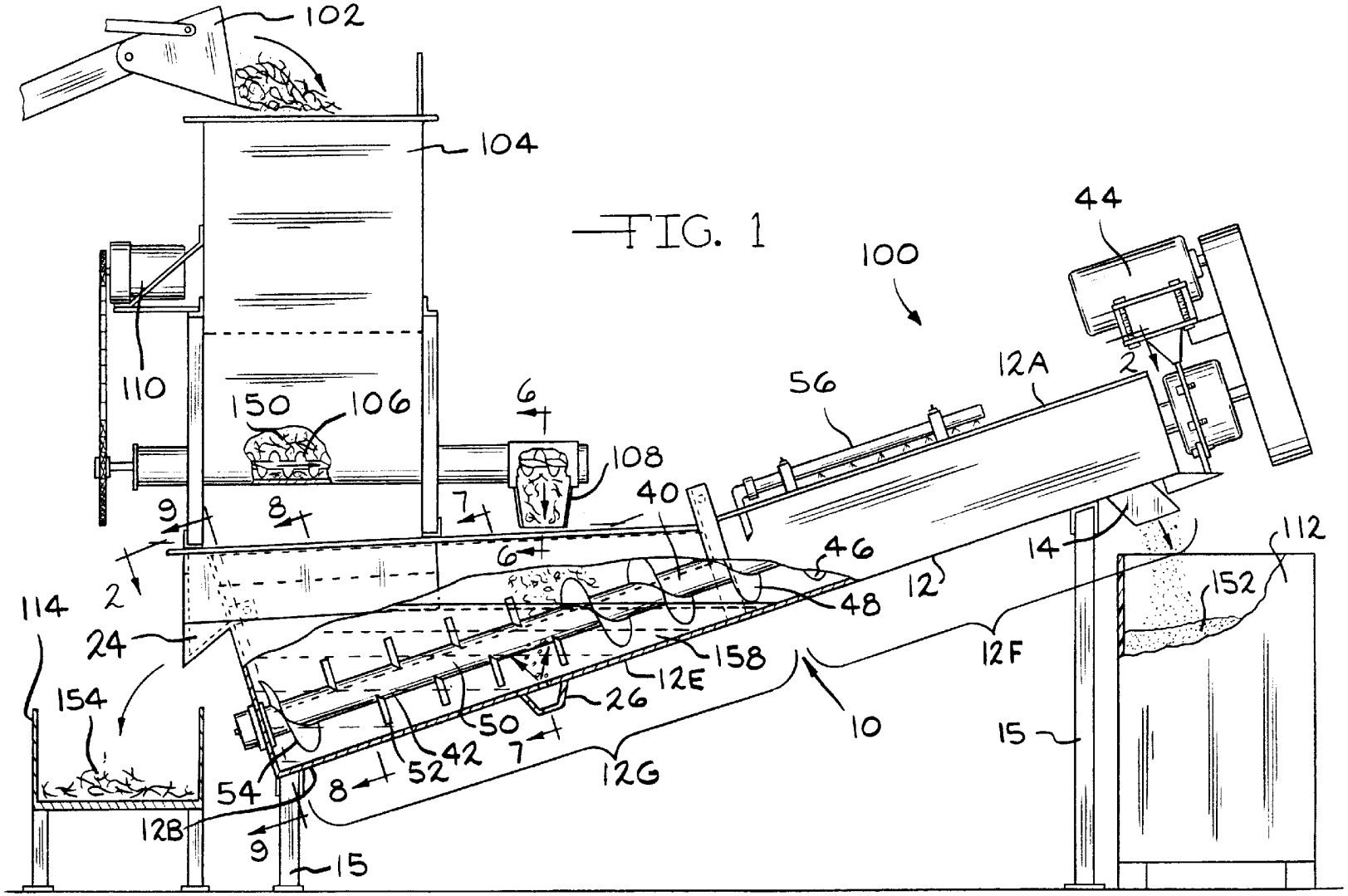
FIG. 1 is a perspective view of the separation apparatus 10 with the mixture loader 102, the hopper 104, and the upper and lower collection bins 112 and 114.

The present invention relates to an apparatus for separating a first material from a second less dense material in a mixture of the materials, which comprises: a container means having a top and a bottom; dispersing means mounted on the container means between the top and the bottom of the container means to disperse the mixture in the container means; fluid supply means for introducing a fluid into the container means, wherein the fluid is a mixture of air and water; feed means for feeding the mixture above the fluid supply means in the container means; first removal means provided in the container means for removing the first material from the container means; and second removal means on the container means for removing the fluid with the second less dense material from the container means.

Further, the present invention relates to an apparatus for separating a first material from a second, less dense material in a mixture of the materials, which comprises: an inclined container means having a bottom and sides between spaced apart ends with one of the ends being lower than the other end wherein the lower end can contain an aqueous suspension and wherein the second less dense material overflows from the end which is lower; screw means for dispersing the mixture and conveying the first material mounted between the ends of the container means in closely spaced relation to one of the sides and the bottom wherein the screw means comprises a shaft and screw members along the shaft between the ends of the container means, the screw means is rotatable to convey the first material out of the other end of the container means which is higher; fluid supply means for introducing a fluid into the container means intermediate the ends wherein the fluid includes air and water; drive means for rotating the shaft of the screw means; spray means mounted along a segment of the container means above a water level in the container means for washing the first material conveyed by the screw means; and feed means for feeding the mixture above the fluid supply means in the container means.

Still further, the present invention relates to a method for separating a first material from a second, less dense material in a mixture having the first and second materials, which comprises: providing a container means having a top and a bottom; dispersing means mounted on the container means between the top and the bottom of the container means to disperse the mixture in the container means; fluid supply means for introducing a fluid into the container means for suspending the second less dense material and for dispersing the mixture, wherein the fluid is a mixture of air and water;

feed means for feeding the mixture above the fluid supply means in the container means; first removal means provided in the container means for removing the first material from the container means; and second removal means on the container means for removing the fluid with the second less dense material from the container means with the fluid supply means activated; depositing the mixture into the feed means of the apparatus which feeds the mixture into the container means containing an aqueous suspension and into the dispersing means; removing the first material from the container means through the first removal means; and removing the second material from the container means through the second removal means.

Finally, the present invention relates to a method for separating a first material from a second less dense material in a mixture having the first and second materials, which comprises: providing an inclined container means having a bottom and sides between spaced apart ends with one of the ends being lower than the other end wherein the lower end can contain an aqueous suspension and wherein the second less dense material overflows from the end which is lower; screw means for dispersing the mixture and conveying the first material mounted between the ends of the container means in closely spaced relation to one of the sides and the bottom wherein the screw means comprises a shaft and screw members along the shaft between the ends of the container means, the screw means is rotatable to convey the first material out of the other end of the container means which is higher; fluid supply means for introducing a fluid into the container means intermediate the ends for suspending the second less dense material and for dispersing the mixture wherein the fluid includes air and water; drive means for rotating the shaft of the screw means; spray means mounted along a segment of the container means above a water level in the container means for washing the first material conveyed by the screw means; and feed means for feeding the mixture above the fluid supply means in the container means with the fluid supply means, screw means and spray means activated; introducing the first material and the second less dense material into the feed means which feeds the mixture into the container means containing an aqueous suspension; removing the first material through the screw means by conveying the first material out of the other end of the container means which is higher; and removing the second material, and the fluid by flowing the second less dense material and the fluid over the one end of the container means which is lower.

As shown in FIGS. 1 to 9, the second, less dense material 154 and the fluid from the fluid supply means or fluid distribution manifold 158 form an aqueous suspension. A weir 20 is located adjacent the top of the container means or trough 12 to allow for removing the suspended second material 154 and the fluid from the container means or trough. The container means or trough 12 slopes upward from the first or lower end 12B to the second or upper end 12A at a slope of between about 1° and 45°. The container means or trough 12 adjacent the second or upper end 12A has opposed sides 12C and 12D, wherein one of the sides 12D has an arcuate shape and the other side 12C forms a right angle with the bottom 12E of the container means or trough 12. A spray means or spray bar 56 is provided along the top of the container means or trough 12 adjacent the side 12D having the arcuate shape for washing the first material 152 as it is moved upward by a screw means 40 toward the second or upper end 12A of the container means or trough 12. The screw means 40 has first and second portions 46 and 50 which share a unitary shaft 42. The first portion or dispersing portion 50 of the screw means 40 has paddles 52 which act as a dispersing means to disperse the mixture 150 and as a conveying means to move the first material 152 toward the second or upper end 12A of the container means or trough 12. The second portion or screw conveying portion 46 of the screw means 40 has screw members or flights 48 which act to convey the second material 154 toward the second or upper end 12A of the container means or trough 12. The mixture 150 is slowly fed into the trough 12 from a hopper 104 by a screw feed or conveyor 106.

Other specific embodiments of the method and apparatus are described in detail in application Ser. No. 08/621,532, filed on Mar. 25, 1996, which is included herein by reference. The apparatus of the first embodiment includes a tank with an upper grate, a lower grate, an air supply tube and a water supply tube. The apparatus of the second embodiment includes a tank having a screened grate, an air supply tube and a water supply tube. The apparatus of the third embodiment includes a tank having an upper portion and a conical lower portion with a grate between the two portions. In operation, all three embodiments essentially operate similarly. The chamber of the tank is filled with water. The mixture is then dumped into the chamber to form the aqueous suspension with the water. In all three embodiment, the flow of air and water if present, agitates the mixture in the suspension which causes the mixture to break down and the sand to separate from the manure. The sand settles on the floor of the tank while the manure remains suspended in the suspension.

FIG. 1 shows the preferred separation system 100 which uses the separating apparatus 10 of the present invention. The mixture 150 is separated into first and second materials 152 and 154 with the second material 154 being less dense than the first material 152. In addition, a third material 156 is preferably also contained in the mixture 150 and separated from the first and second material 152 and 154. However, in a preferred embodiment, the separation of the third material 156 is by the density and size of the third material 156. In a preferred embodiment, the first material 152 is sand, the second less dense material 154 is animal manure and the third material 156 is preferably coarse undigested feed. It is understood that the system can be used to separate a variety of different mixtures having materials of different densities. For instance, in the aggregate industry, the system could be used to separate sand and clay.

The separation system 100 includes a material loader 102, a hopper 104, the separation apparatus 10 and an upper and lower collection bin 112 and 114. The system 100 is used to separate materials 152 and 154 having different densities which are mixed together in a mixture 150. The material loader 102 is preferably a standard front end loader such as those well known in the art (FIG. 1). However, any means of loading the mixture 150 into the hopper 104 can be used. The feed bin or hopper 104 is preferably similar to those well known in the art. The hopper 104 preferably has a wide open top and narrows toward the bottom. A screw conveyor 106 is located in the bottom of the hopper 104 for moving the mixture 150 from the hopper 104 and out the feed opening 108. A drive motor 110 is provided to rotate the screw conveyor 106. The hopper 104 is positioned so that the feed opening 108 is directly over the fluid orifices 28 in the bottom 12E of the trough 12 (to be described in detail hereinafter). The shape of the hopper 104 and the size of the screw conveyor 106 and the feed opening 108 allows only a limited amount of the mixture 150 to be fed into the separation apparatus 10 at one time. The metering of the mixture 150 into the separation apparatus 10 allows the mixture 150 to be separated easier and more efficiently.

Figure 2:
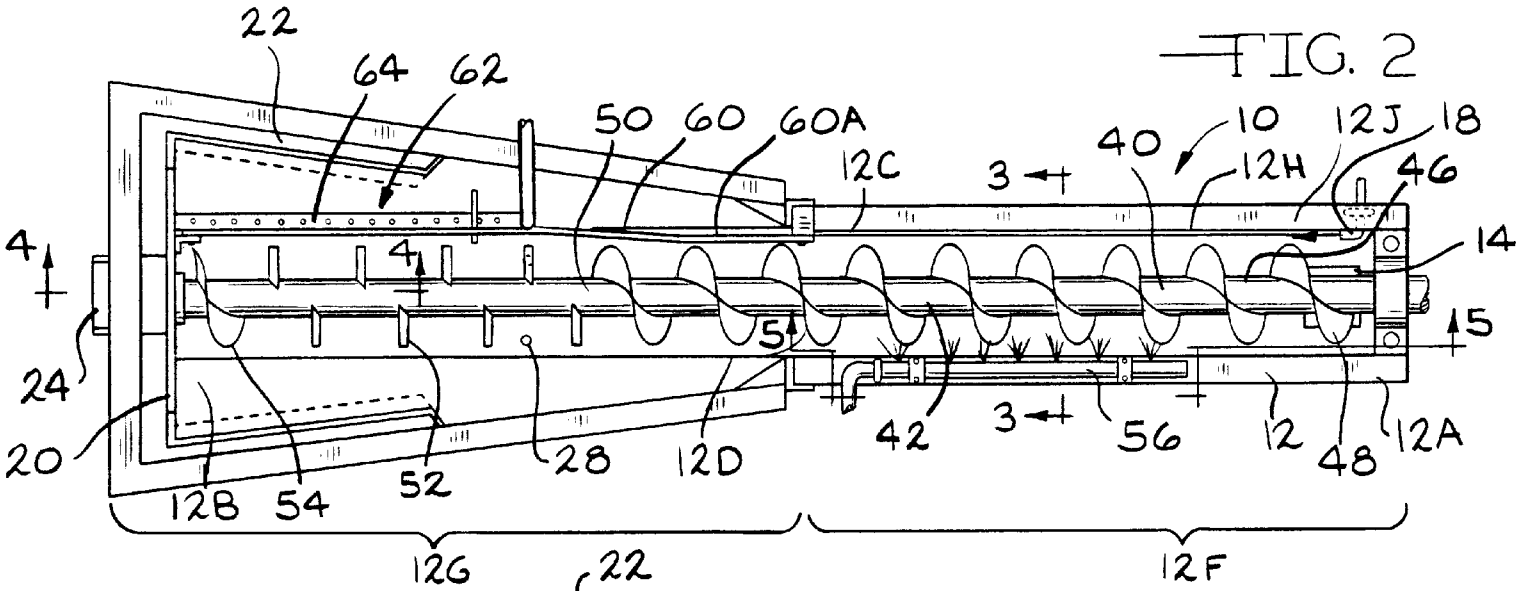
FIG. 2 is a top view of the apparatus 10 without the drive motor 44 showing the conveying and dispersing screw means 40 with the screw conveying portion 46 and the dispersing portion 50.
Figure 3:
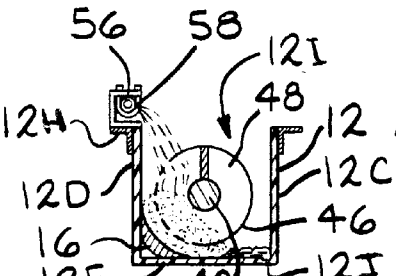
FIG. 3 is a cross-sectional view along the line 3—3 of FIG. 2 showing the arcuate insert 16 adjacent the second side 12D of the trough 12 and the spray bar 56.
Figure 6:
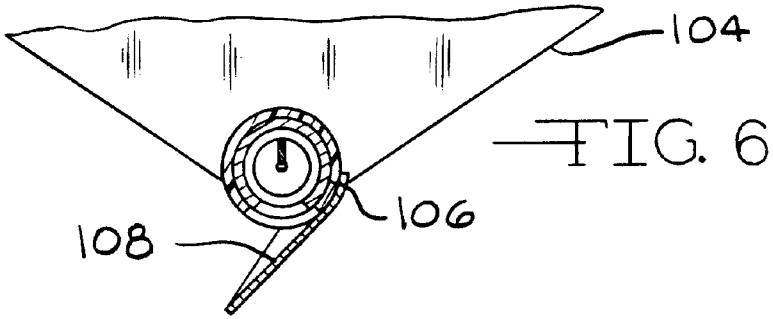
FIG. 6 is a cross-sectional view along the line 6—6 of FIG. 1 showing the screw conveyor 106 in the feed opening 108.
Figure 8:
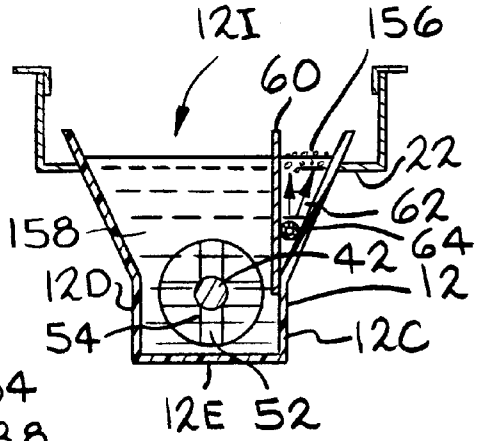
FIG. 8 is a cross-sectional view along the line 8—8 of FIG. 1 showing partition 60, the separate chamber 62 and the aeration tube 64.
Figure 9:
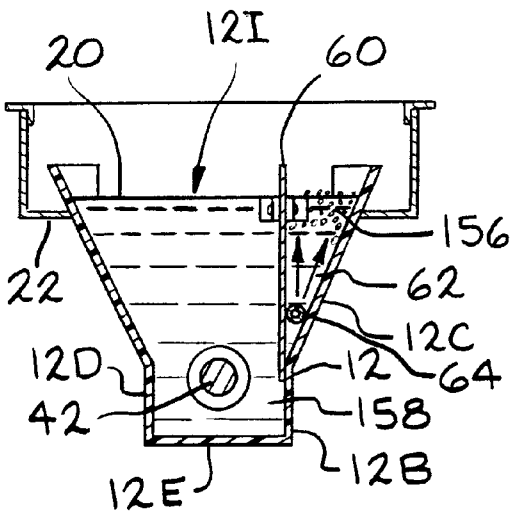
FIG. 9 is a cross-sectional view along the line 9—9 of FIG. 1 showing the partition 60, the separate chamber 62 and the aeration tube 64.
Figure 7:
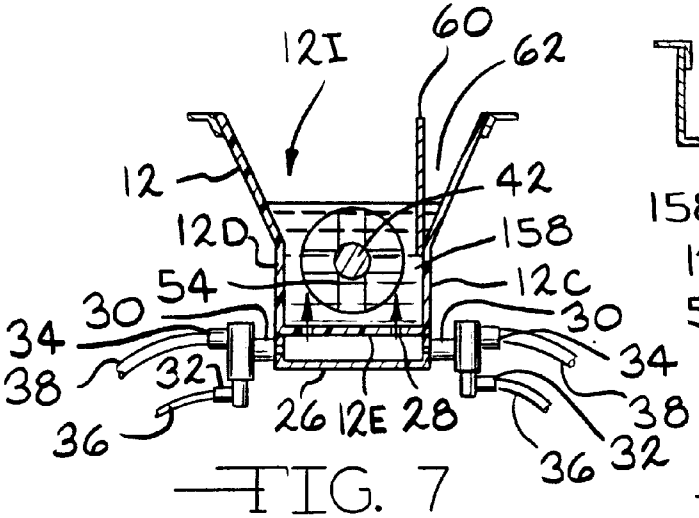
FIG. 7 is a cross-sectional view along the line 7—7 of FIG. 1 showing the water and air supply hoses 38 and 36, the fluid distribution manifold 26 and the fluid orifices 28 in the bottom 12E of the trough 12.

The separation apparatus 10 includes a trough 12, a fluid distribution manifold 26 and a conveying and dispersing screw means 40 (FIG. 2). The trough 12 has an upper end 12A and a lower end 12B with opposed first and second sides 12C and 12D and a bottom 12E extending therebetween forming an upper portion 12F and a lower portion 12G. In the upper portion 12F of the trough 12, the sides 12C and 12D of the trough 12 are perpendicular to the bottom 12E of the trough 12 with the top of the trough 12 open (FIG. 3). In the upper portion 12F, the tops of the sides 12C and 12D opposite the bottom 12E have flanges 12H which extend outward away from the inside 12I of the trough 12. In the lower portion 12G of the trough 12, the sides 12C and 12D adjacent the bottom 12E of the trough 12 are perpendicular to the bottom 12E. The sides 12C and 12D extend upward a short distance perpendicular to the bottom 12E. The sides 12C and 12D then angle outward away from the other side as the sides 12C and 12D extend upward. The top of the trough 12 at the lower portion 12G is wider than the bottom 12E of the trough 12 (FIGS. 7 to 9). The sides 12C and 12D of the lower portion 12G of the trough 12 extend upward at about an 18° angle from the vertical perpendicular to the bottom 12E of the trough 12. The slope of the sides 12C and 12D of the lower portion 12G of the trough 12 is such as to control the turbulence and water velocity in the pool area at the lower end 12G of the trough 12. The shape of the lower portion 12G of the trough 12 allows the first material 152 to be retained in the trough 12 without allowing the second material 154 and the first fractions of the first material 152 to settle out of the aqueous suspension 158. The angled sides 12C and 12D of the lower portion 12G of the trough 12 allow for faster and more efficient separation of the mixture 150. The lower portion 12G of the trough 12 adjacent the lower end 12B forms a pool area. The trough 12 is inclined upward such that the lower end 12B of the trough 12 is lower than the upper end 12A of the trough 12. The trough 12 is preferably mounted on legs 15. The legs 15 can be provided with wheels (not shown) to allow the trough 12 to be portable. The trough 12 preferably angles upward at a slope of between 1° and 45° with about 18° being preferred. A shallow groove 12J is provided in the bottom 12E of the trough 12 adjacent the first side 12C of the trough 12. The groove 12J extends the entire length of the upper portion 12F of the trough 12. A wash water outlet 18 would be provided in the bottom 12E of the trough 12 at the upper end 12A adjacent the first side 12C of the trough 12. In a preferred embodiment, the wash water outlet 18 is provided directly in line with the groove 12J and is aimed such as to discharge a flow of water down the trough 12 in the groove 12J as needed. An upper discharge spout 14 is located in the bottom 12E of the trough 12 adjacent the upper end 12A of the trough 12. In a preferred embodiment, the trough 12 has a length of 99 inches (21 cm) between the ends 12A and 12B with the upper portion 12F having a length of 48 inches (10 cm). In the upper portion 12F, the sides 12C and 12D of the trough 12 have a height of 10.0 inches (25.4 cm) and the bottom 12E has a width of 12.0 inches (30.5 cm). In the lower portion 12G, the bottom 12E has the same width as in the upper portion 12F of the trough 12. However, the sides 12C and 12D of the trough 12 at the lower end 12B have a height of about 21.0 inches (53.3 cm) such that the trough 12 is deepest at the lower end 12B of the trough 12. The sides 12C and 12D and bottom 12E of the trough 12 are preferably constructed as a unitary piece. The trough 12 is preferably constructed of steel, however, any similar durable material can be used.

An arcuate insert 16 is mounted in the inside 12I of the trough 12 between the second side 12D and the bottom 12E of the trough 12. In a preferred embodiment, the arcuate insert 16 extends the entire length of the upper portion 12A of the trough 12. Preferably, the arcuate angle of the arcuate insert 16 is dependent on the radius of the flights 48 on the conveying portion 46 of the conveying and dispersing screw means 40 (to be described in detail hereinafter). The arcuate insert 16 creates an arcuate shape along the second side 12D of the trough 12 adjacent the bottom 12E of the trough 12.

In a preferred embodiment, the arcuate insert 16 is mounted in the trough 12 however, the trough 12 could also be constructed with the second side 12D having an arcuate lower side portion.

An overflow weir 20 is located at the lower end 12B of the trough 12. An overflow channel 22 is located behind the overflow weir 20 on the side opposite the trough 12. The overflow channel 22 guides the second material 154 and fluid into a lower discharge spout 24. The lower collection bin 114 is positioned below the lower discharge spout 24 to collect the removed fluid and second and third materials 154 and 156. Additional overflow weirs 20 are also provided along the sides 12C and 12D of the trough 12 adjacent the lower end 12B of the trough 12 to increase the removal area for the fluid and second and third materials 154 and 156. The overflow channel 22 is extended accordingly around the sides 12C and 12D of the trough 12 such that the overflow channel 22 extends behind all of the overflow weirs 20. The height of the overflow weir 20 is preferably adjustable to allow variations in the water level. In a preferred embodiment, the top of the overflow weir 20 is positioned 2.5 inches (6.4 cm) down from the height of the lower end 12B of the trough 12. The trough 12 as described above with the overflow weir 20, the upper and lower discharge spouts 14 and 24, the wash water outlet 18, the groove 12J and the arcuate insert 16 is preferably similar to the fine material screw classifiers manufactured by McLanahan Corporation of Hollidaysburg, Pa.

A fluid distribution manifold 26 is located below the bottom 12E of the trough 12 in the lower portion 12G of the trough 12. Fluid orifices 28 are located in the bottom 12E of the trough 12 over the fluid distribution manifold 26 and allow the fluid distribution manifold 26 to be in fluid communication with the inside 12I of the trough 12 (FIG. 7). The orifices 28 must be located below the water line in the lower portion 12G of the trough 12. In a preferred embodiment, the orifices 28 are located 28.0 inches (71.0 cm) from the lower end 12B of the trough 12 and 1.25 inches (3.18 cm) from each side 12C and 12D of the trough 12. In a preferred embodiment, there is a single fluid distribution manifold 26 and orifices 28. However, it is understood that any number of fluid distribution manifolds 26 or orifices 28 can be used when necessary. The placement of the fluid distribution manifold or manifolds 26 and the orifices 28 can be varied. However, the feed opening 108 of the hopper 104 should be varied accordingly such that the mixture 150 is always fed directly over the orifices 28. The fluid distribution manifold 26 has a pair of fluid inlets 30 on each side each having an air inlet 32 and a water inlet 34 (FIG. 7). The air inlets 32 are connected by air hoses 36 to an air supply (not shown). The air supply is preferably a compressor; however, any type air supply may be used. The air supply provides 1 to 20 CFM of air to the manifold 26 with a pressure of 1 to 100 PSI. Preferably, the pressure is not necessary to overcome the static head of the water in the container plus the frictional losses in the inlet. The air inlets 32 are preferably connected to an air valve (not shown) and an air meter (not shown) to allow the user to adjust the amount of air flowing into the fluid distribution manifold 26 and the trough 12. The water inlets 34 are preferably connected to a water supply by water hoses 38. In a preferred embodiment, the water supply is of any type such as a direct hook up to the water supply for a building (not shown) housing the apparatus 10 or to a pond (not shown). In a preferred embodiment, the water supply provides 1 to 10 gallon/minute/ton per hour of feed to the water inlets 34. The water inlets 34 are preferably connected to a water valve (not shown) and a water meter (not shown) which allows the user to vary the amount of water entering the fluid distribution manifold 26 and the trough 12.

A conveying and dispersing screw means 40 is located between the ends 12A and 12B of the trough 12. The conveying and dispersing means 40 includes a screw conveying portion 46 and a dispersing portion 50 which share a common shaft 42. The shaft 42 is rotatably connected at the upper and lower ends 12A and 12B of the trough 12. A drive motor 44 is connected to the shaft 42 at the upper end 12A of the trough 12 to rotate the conveying and dispersing means 40. The drive motor 44 is preferably a 2 to 25 hp motor. In a preferred embodiment, the screw 42 has a total peripheral diameter including the flights 48 of 10 to 44 inches and rotates at a speed of 5 to 30 rpm.

The conveying portion 46 of the screw means 40 extends the entire length of the upper portion 12F of the trough 12 and into the lower portion 12G of the trough 12. The conveying portion 46 extends from the upper end 12A of the trough 12 to slightly above the fluid distribution manifold 26. The conveying portion 46 has screw members or flights 48 which are mounted on the shaft 42 and extend the entire length of the conveying portion 46. The flights 48 are of such a size and the conveying portion 46 is positioned such that the flights 48 are closely adjacent the bottom 12E of the trough 12 and the arcuate insert 16 (FIG. 3). The flights 48 are spaced apart from the bottom 12E of the trough 12 and the arcuate insert 16 a distance of between 1 times and up to 4 times the diameter of the largest particle of the first material 152 to be removed by the screw conveying portion 46 of the trough 12 and the arcuate insert 16 so that two particles can not get caught between the flights 48 and the trough 12 or arcuate insert 16. This helps to prevent the conveying and dispersing screw means 40 from jamming. The diameter of the largest particle of the first material 152 is preferably about 0.5 inches (1.3 cm) and the flights 48 are spaced a distance of 0.5 to 2.00 inches from the bottom 12E of the trough 12 and the arcuate insert 16. Preferably, the flights 48 do not extend above the sides 12C and 12D of the trough 12. Preferably, the flights 48 extend outward from the center line of the shaft 42 5 inches to 22 inches in radius and are preferably spaced 5.0 inches (12.7 cm) apart center to center such that the pitch (flight to flight the diameter) is between 0.25 and 0.50 inches (0.64 and 1.3 cm) the peripheral of the shaft 42 with the flights 48.

Figure 4:
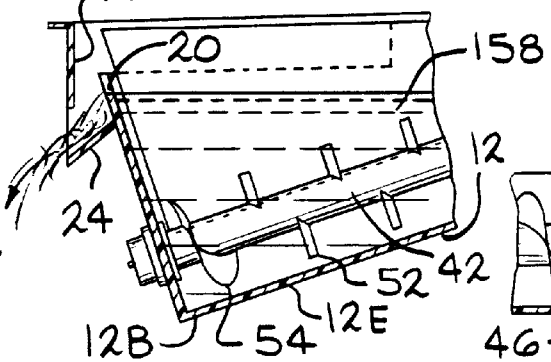
FIG. 4 is a cross-sectional view along the line 4—4 of FIG. 2 showing the overflow weir 20 and the lower discharge spout 24.

In a preferred embodiment, the dispersing portion 50 of the screw means 40 extends from the lower end 12B of the trough 12 to slightly above the orifices 28 of the fluid distribution manifold 26 toward the upper end 12A of the trough 12. The dispersing portion 50 includes paddles 52 mounted on the shaft 42. The paddles 52 extend outward a distance of from center line 5 inches to 22 inches (12.7 cm to 55.9 cm). The paddles 52 are preferably spaced 5.0 inches (12.7 cm) apart center to center along the shaft 42 and are spaced 90° apart in a spiral around the shaft 42. In some cases, they are closer or further apart. A flight 54 similar to the screw flights 48 of the conveying portion 46 is positioned on the end of the shaft 42 adjacent the lower end 12B of the trough 12 (FIG. 4). The flight 54 acts to prevent the aqueous suspension 158 contained in the lower portion 12G of the trough 12 from building up and packing around the bearing (not shown) around the shaft 42. The flight 54 moves the first material 152 away from the bearing similar to the flights 48 of the screw conveying portion 46.

Figure 5:
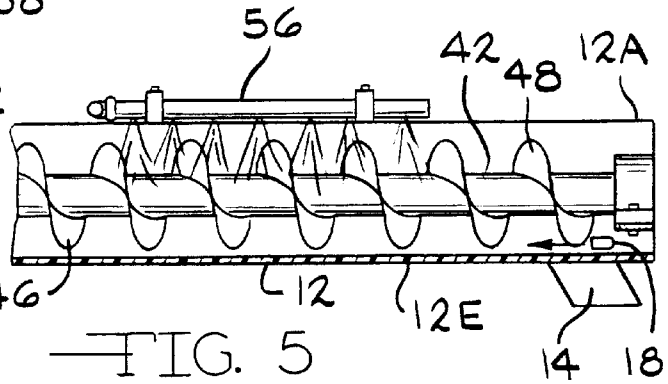
FIG. 5 is a cross-sectional view with parts in elevation along the line 5—5 of FIG. 2 showing the spray bar 56 and the upper discharge spout 14.

A spray bar 56 is mounted on the flange 12H on the second side 12D of the upper portion 12F of the trough 12. The spray bar 56 is positioned parallel to and above the conveying portion 46 of the conveying and dispersing screw means 40. The orifices 58 of the spray bar 56 are located on the inner side of the spray bar 56 and are angled downward such that the spray bar 56 sprays water on the flights 48 of the conveying portion 46 adjacent the arcuate insert 16 (FIG. 5). The orifices 58 are positioned at approximately a 45° angle with the second side 12D of the trough 12 so as to move the removed third material 156 toward the first side 12C of the trough 12. In a preferred embodiment, the spray bar 56 is connected to the same water supply as the water inlets 34 of the fluid distribution manifold 26. The spray bar 56 preferably has a length such as to extend 75% of the length of the conveying portion 46 of the dispersing and conveying means which extends above the water level in the lower end 12B of the trough 12. In a preferred embodiment, the spray bar 56 has a length of about 24 inches (61.0 cm) and an inner diameter of 0.0625 inches (0.1588 cm). The orifices 58 have a diameter of 0.0625 inches (0.1588 cm) and are spaced 10 inches (2.54 cm) apart at the lower end 12B and about 2.0 inches (5.08 cm) at the upper end 12A near the upper end 12A of the trough 12. The greater spacing of the orifices 58 at the upper end of the spray bar 56 allows for better dewatering of the first material 152 as the material 152 moves toward the upper discharge spout 14. Preferably, the majority of the third material 156 and other organic solids have been washed from the first material 152 before the first material 152 reaches the upper end 12A of the spray bar 56. The spray bar 56 preferably has a water output of 4 gallon/minute preferably 1 to 10 gallon/ton per hour of manure..

A partition 60 is located in the lower portion 12G of the trough 12 adjacent the first side 12C (FIGS. 7 to 9). The partition 60 extends the entire length of the lower portion 12G of the trough 12. The bottom of the partition 60, except for at the front part 60A of the partition 60, is mounted on the side 12C of the trough 12 just below the point at which the side 12C begins to angle outward so that the partition 60 forms a wall in the trough 12 perpendicular to the bottom 12E of the trough 12. The partition 60 with the angled first side 12C of the trough 12 forms a V-shaped chamber 62. The front part 60A of the partition 60 adjacent the upper portion 12F of the trough 12 is bent inward toward the conveying and dispersing screw means 40 such that there is a space between the bottom of the partition 60 and the first side 12C of the trough 12. The partition 60 preferably is of a height as to be flush with the top of the sides 12C and 12D of the trough 12. The fluid supply means 64 is positioned along the bottom of the chamber 62. The fluid supply means 64 preferably extends from the lower end 12B of the trough 12 to the point where the partition 60 begins to bend inward away from the second side 12D of the trough 12 such that the entire tube 64 is located below the water level in the chamber 62. The secondary fluid distribution manifold 64 provides both air and water into the chamber 62.

IN USE

To use the separation system 100, the system 100 is first configured such that the feed opening 108 of the hopper 104 is directly above the fluid orifices 28, the upper collection bin 112 is beneath the upper discharge spout 14 and the lower collection bin 114 is beneath the lower discharge spout 24. Next, the water and air inlets 34 and 32 of the fluid distribution manifold 26 are connected to the water and air supplies respectively. The spray bar 56 and the wash water outlet 18 are also connected to the water supply and the aeration tube 64 is connected to an air supply. Preferably, only one water supply and one air supply is needed. The fluid distribution manifold 26, the spray bar 56, and the aeration tube 64 are preferably all activated prior to inserting the mixture 150 into the trough 12. However, it is possible to activate the spray bar 56 and the aeration tube 64 after the apparatus 10 has begun operating. The wash water outlet 18 is activated as needed when the upper portion 12F of the trough 12 appears clogged with the third material 156. The mixture 150 is then dumped into the hopper 104 using the mixture loader 102. The drive motor 44 is activated to begin rotation of the conveying and dispersing screw means 40. Next, the screw conveyor 106 in the hopper 104 is activated and the mixture 150 is fed into the trough 12. In a preferred embodiment, the mixture 150 is not fed into the trough 12 until the water level in the lower portion 12G of the trough 12 is level with the overflow weir 20 at the lower end 12B of the trough 12 (FIG. 4). As the mixture 150 moves along the screw conveyor 106, the mixture 150 is spread out so that the mixture 150 is carefully metered into the trough 12. As the mixture 150 leaves the feed opening 108, the mixture 150 drops into the trough 12 above the fluid distribution orifices 28 and the paddles 52 of the dispersing portion 50 of the conveying and dispersing screw means 40. The rotating paddles 52 contact the mixture 150 and act to disperse the mixture 150. The contact of the rotating paddles 52 with the water in the lower portion 12G of the trough 12 also acts to further disperse the mixture 150 which has entered the water in the pool area in the lower portion 12G of the trough 12. In addition, the air and water introduced through the fluid distribution orifices 28 also helps to disperse the mixture 150. As the mixture 150 becomes dispersed, the mixture 150 and the water in the pool area form an aqueous suspension 158, the upward momentum imparted by the air and water introduced through the fluid distribution orifices 28 into the aqueous suspension 158 causes the second material 154 to become suspended in the aqueous suspension 158. The use of air along with the water to disperse the mixture 150 and create the current flow in the aqueous suspension 158 decreases the total amount of water needed n the separation process. As a result of using less water the second material 154 is less diluted and has less volume when it flows out of the lower discharge spout 24 which means that less area is needed for storage of the separated second material 154. Using less water also reduces the cost of operating the system 100. As the separation process continues, the level of the aqueous suspension 158 in the lower portion 12G of the trough 12 rises so that the aqueous suspension 158 including the second material 154 and the water flows over the overflow weir 20 at the lower end 12B of the trough 12. The second material 154 flows into the overflow channel 22 and out through the lower discharge spout 24 into the lower collection bin 114. At the same time, the first material 152 which has a greater density settles out of the aqueous suspension 158 onto the bottom 12E of the trough 12 due to gravity. The first material 152 which has settled on the bottom 12E of the trough 12 is moved upward by both the paddles 52 of the dispersing portion 50 or the screw flights 48 of the conveying portion 46 of the conveying and dispersing screw means 40 depending upon the location of the first material 152 in the trough 12. The paddles 52 of the dispersing portion 50 move the settled first material 152 toward the flights 48 of the conveying portion 46 of the conveying and dispersing screw means 40. As the first material 152 is moved upward out of the aqueous suspension 158 and into the upper portion 12F of the trough 12, the close proximity of the flights 48 of the screw conveying portion 46 with the bottom 12E of the trough 12 and the arcuate insert 16 prevents the first material 152 from sliding back into the aqueous suspension 158. As the first material 152 is moved upward by the screw conveying portion 46 of the conveying and dispersing screw means 40, the water from the spray bar 56 acts to wash the first material 152 to remove additional amounts of the second material 154 as well as other material such as the third material 156. The wash water outlet 18 at the upper end 12A of the trough 12 introduces a flow of water along the first side 12C of the trough 12 preferably in the groove 12J in the bottom 12E of the trough 12 which moves the removed second material 154 and other materials 156 down the trough 12 and into the aqueous suspension 158. The groove 12J in the upper portion 12F of the trough 12 allows the removed second other materials 154 to flow down the trough 12 undisturbed by the flights 48 of the screw conveying portion 46. The flow of water from the wash water outlet 18 and the spray bar 56 also creates a current flow which causes the aqueous suspension 158 and the suspended second material 154 to flow over the overflow weir 20 at the lower end 12B of the trough 12. In addition, the flow of water down the trough 12 past the flight 48 creates a syphoning effect which acts to remove additional water from the first material 152 as the first material 152 is conveyed up the trough 12. The inclined angle of the trough 12 also aids in allowing the water in the first material 152 to drain back into the lower portion 12G of the trough 12. The separated, washed and relatively dewatered first material 152 is conveyed up the trough 12 through the upper discharge spout 14 and into the upper collection bin 112.

In a preferred embodiment, the mixture 150 also contains a third material 156 made up of large sized, coarse components. The third material 156 settles out of the aqueous suspension 158 with the first material 152 and is moved upward out of the aqueous suspension 158 by the flights 48 of the screw conveying portion 40. As the third material 156 is moved upward, the third material 156 is washed from the first material 152 by water from the spray bar 56. The third material 156 is washed into the groove 12J in the bottom 12E of the trough 12 and is then washed down the trough 12 by water from the wash water outlet 18. As the large sized coarse components of the third material 156 are washed downward, the third material 156 is diverted by the partition 60 into the separate side chamber 62 in the lower portion 12G of the trough 12. The partition 60 prevents the coarse third material 156 from continuously recirculating around the trough 12. The upward flow of air from the aeration tube 64 in the chamber 62 causes the third material 156 collected in the chamber 62 to become suspended in the water in the chamber 62. As the separation process continues and the level of the aqueous suspension 158 in the lower portion 12G of the trough 12 including the chamber 62 rises, the suspended third material 156 flows over the overflow weir 20 at the lower end 12B of the trough 12 and into the overflow channel 22. The third material 156 is recombined with the first material 152 in the overflow channel 22 and flows out of the lower discharge spout 24 and into the lower collection bin 114. The partition 60 also changes the geometry of the lower portion 12G of the trough 12 which creates a faster flow rate of the first material 152, third material 156 and water over the overflow weir 20.

In a preferred embodiment, the mixture 150 contains sand as the first material 152. The second material 154 is mostly comprised of organic solids such as animal manure however, the second material 154 can also contain silt or clay or other material less dense than sand. The third material 156 is preferably coarse organic matter such as undigested feed or corn. The first material 152 which is removed preferably contains only less than 2.0% organic matter (dry basis). Field studies have indicated that sand bedding containing less than 2.0% organic matter (dry basis) is suitable for rebedding. The second material 154, third material 156 and water which is discharged through the lower discharge spout 24 contains less than 2.0% sand. The sand fraction remaining is extremely fine and can be pumped with little difficulty or resultant wear to processing equipment. The second material 154, third material 156 and water which is collected in the lower collection bin 114 may be used to fertilize and irrigate using conventional well known methods and apparatuses for spreading fertilizer. The system preferably operates as a continuous process and separates 2,000 lbs. of mixture per hour. This would handle about 12 to 15 cows per hour. Eight hours equals a 100 cow herd. The average number of cows per herd is less than 100. Large farms may have over 2,000 cows. The amount of mixture 150 able to be handled by the apparatus will depend on the size of the container pool volume and the screw diameter. Overall, the system removes about 95% of the sand from the mixture 150. It is understood that the apparatus 10 and system 100 can be made in a variety of different sizes depending upon the amount of mixture 100 needed to be separated in a given amount of time.

It is intended that the foregoing description be only illustrative of the present invention and that the present invention be limited only by the hereinafter appended claims.

We claim:

1. An apparatus for separating a first material from a second, less dense, material in a mixture of the materials, which comprises:

(a) a container means having a top and a bottom;

(b) dispersing means mounted on the container means between the top and the bottom of the container means to disperse and separate the mixture in the container means;

(c) fluid supply means positioned below the dispersing means adjacent the bottom of the container for introducing a fluid into the container means below the dispersing means to assist in separating the mixture, wherein the fluid is a mixture of air and water;

(d) feed means for feeding the mixture above the fluid supply means in the container means;

(e) first removal means provided in the container means for removing the first material from the container means; and (f) second removal means on the container means for removing the fluid with the second less dense material from the container means.

2. The apparatus of claim 1 wherein the first material is sand.

3. The apparatus of claim 2 wherein the second material is animal manure.

4. The apparatus of claim 1 wherein the dispersing means includes paddles mounted on a shaft which is able to rotate.

5. The apparatus of claim 1 wherein the fluid is introduced into the container through multiple orifices.

6. The apparatus of claim 1 wherein the second less dense material and the fluid form an aqueous suspension in the container means.

7. The apparatus of claim 1 wherein the first removal means is a screw means.

8. The apparatus of claim 1 wherein the second removal means is a weir adjacent the top of the container means.

9. The apparatus of claim 1 wherein a partition means is provided in the container means adjacent the first removal means for diverting relatively large sized components of the second material into a separate section for removal.

10. The apparatus of claim 9 wherein a fluid distribution means is provided in the separate section for suspending the relatively large sized components for removal.

11. The apparatus of claim 1 wherein the container means has a first end and a second end with an upward slope from the first end to the second end between the ends and wherein the fluid supply means is located between the ends.

12. The apparatus of claim 11 wherein the second removal means is positioned adjacent the first end of the container.

13. The apparatus of claim 11 wherein the first removal means is located between the first and second ends of the container means.

14. The apparatus of claim 13 wherein the dispersing means is located between the first end of the container means and the first removal means.

15. The apparatus of claim 14 wherein the dispersing means and the first removal means are a unitary piece.

16. The apparatus of claim 13 wherein the container means has opposed sides, wherein one side adjacent the second end has an arcuate shape and wherein the other side adjacent the second end is a right angle.

17. The apparatus of claim 11 wherein the container means slopes upward from the first end to the second end at a slope of between about 1° and 45°.

18. The apparatus of claim 1 wherein a spray means is provided adjacent the first removal means for washing the first material conveyed by the first removal means from the container means.

19. An apparatus for separating a first material from a second, less dense, material in a mixture of the materials, which comprises:

(a) an inclined container means having a bottom and sides between spaced apart ends with one of the ends being lower than the other end wherein the lower end can contain an aqueous suspension and wherein the second less dense material overflows from the end which is lower;

(b) screw means for dispersing the mixture and conveying the first material mounted between the ends of the container means in closely spaced relation to one of the sides and the bottom wherein the screw means comprises a shaft with conveying members and dispersing members along the shaft between the ends of the container means, the shaft of the screw means is rotatable to rotate the conveying members to convey the first material out of the other end of the container means which is higher and to rotate the dispersing members to disperse the mixture;

(c) fluid supply means for introducing a fluid into the container means intermediate the ends wherein the fluid includes air and water;

(d) drive means for rotating the shaft of the screw means;

(e) spray means mounted along a segment of the container means above a water level in the container means for washing the first material conveyed by the screw means; and (f) feed means for feeding the mixture above the fluid supply means in the container.

20. The apparatus of claim 19 wherein the screw means has a first portion adjacent the one end of the container means and a second portion adjacent the other end of the container means.

21. The apparatus of claim 20 wherein the first portion of the screw means includes the dispersing members and provides a dispersing means for dispersing the mixture adjacent the first end of the container means.

22. The apparatus of claim 21 wherein the dispersing members of the dispersing means are paddles.

23. The apparatus of claim 20 wherein a partition means is located in the container means adjacent the screw means for diverting relatively large sized components of the second material, away from the screw means and into a separate section of the container means.

24. The apparatus of claim 23 wherein a fluid distribution means is provided in the separate section for suspending the relatively large sized components in the aqueous suspension for removal of the components over the one end of the container means which is lower.

25. The apparatus of claim 19 wherein a discharge means is located adjacent the one end of the container means which is lower for guiding the second material and the fluid which overflows the one end of the container means into a collector means.

26. The apparatus of claim 19 wherein the second material is animal manure and the first material is sand.

27. A method for separating a first material from a second, less dense, material in a mixture having the first and second materials, which comprises:

(a) providing an apparatus including a container means having a top and a bottom; dispersing means mounted on the container means between the top and the bottom of the container means to disperse and separate the mixture in the container means; fluid supply means positioned below the dispersing means adjacent the bottom of the container for introducing a fluid into the container means for suspending the second less dense material and for dispersing the mixture, wherein the fluid is a mixture of air and water; feed means for feeding the mixture above the fluid supply means in the container means; first removal means provided in the container means for removing the first material from the container means; and second removal means on the container means for removing the fluid with the second less dense material from the container means;

(b) depositing the mixture into the feed means of the apparatus which feeds the mixture into the container means containing an aqueous suspension and into the dispersing means;

(c) activating the dispersing means and the fluid supply means to agitate the aqueous suspension to disperse the mixture in the aqueous suspension and to separate the first material from the second material in the mixture;

(d) removing the first material from the container means through the first removal means; and (e) removing the second material from the container means through the second removal means.

28. The method of claim 27 wherein a partition means is provided in the container means and forms a separate section adjacent the first removal means wherein the mixture contains a third material having relatively large sized components wherein the third material is diverted by the partition means into the separate section and wherein the third material is removed from the separate section by the second removal means.

29. The method of claim 28 wherein the third material is coarse, organic solids and the separate section also contains the aqueous suspension and a fluid distribution means is provided in the separate section for suspending the third material in the aqueous suspension such that the third material flows out of the separate section into the second removal means and wherein the second removal means removes the third material.

30. A method for separating a first material from a second, less dense, material in a mixture having the first and second materials, which comprises:

(a) providing an inclined container means having a bottom and sides between spaced apart ends with one of the ends being lower than the other end wherein the lower end can contain an aqueous suspension and wherein the second less dense material overflows from the end which is lower; screw means for dispersing the mixture and conveying the first material mounted between the ends of the container means in closely spaced relation to one of the sides and the bottom wherein the screw means comprises a shaft with conveying members and dispersing members along the shaft between the ends of the container means, the shaft of the screw means is rotatable to rotate the conveying members to convey the first material out of the other end of the container means which is higher and to rotate the dispersing members to disperse the mixture; fluid supply means for introducing a fluid into the container means intermediate the ends for suspending the second less dense material and for dispersing the mixture wherein the fluid includes air and water; drive means for rotating the shaft of the screw means; spray means mounted along a segment of the container means above a water level in the container means for washing the first material conveyed by the screw means; and feed means for feeding the mixture above the fluid supply means in the container means with the fluid supply means, screw means and spray means activated;

(b) introducing the first material and the second less dense material into the feed means which feeds the mixture into the container means containing an aqueous suspension;

(c) activating the dispersing means and the fluid supply means to agitate the aqueous suspension to disperse the mixture in the aqueous suspension and to separate the first material from the second material in the mixture:

(d) removing the first material through the screw means by conveying the first material out of the other end of the container means which is higher; and (e) removing the second material and the fluid by flowing the second less dense material and the fluid over the one end of the container means which is lower.

31. The method of claim 30 wherein the screw means has a first portion adjacent the one end of the container means and a second portion adjacent the other end of the container means and wherein the first portion of the screw means provides a dispersing means for dispersing the mixture adjacent the first end of the container.

32. The method of claim 30 wherein a partition means is located in the container means and forms a separate section adjacent the screw means wherein the mixture contains a third material having relatively large sized components wherein the third material is removed with the first material by the screw means and wherein as the first and third materials are conveyed toward the other end of the container means, the partition diverts the third material away from the screw means and into the separate section of the container means.

33. The method of claim 32 wherein the separate section also contains the aqueous suspension and a fluid distribution means is provided in the separate section for suspending the third material in the aqueous suspension such that the third material flows over the one end of the container means which is lower and is removed with the second, less dense material and the fluid.

* * * * *